US005679615A

United States Patent [19]

Matsumoto et al.

[11] Patent Number: 5,679,615

[45] Date of Patent: Oct. 21, 1997

[54] REVERSIBLE HEAT-SENSITIVE RECORDING MEDIUM

[75] Inventors: Tatsuru Matsumoto; Kenichi Tanaka, both of Shizuoka, Japan

[73] Assignee: Tomoegawa Paper Co., Ltd., Tokyo, Japan

[21] Appl. No.: 527,516

[22] Filed: Sep. 13, 1995

[30] Foreign Application Priority Data

Sep. 13, 1994 [JP] Japan ..... 6-243417
Aug. 9, 1995 [JP] Japan ..... 7-222786

[51] Int. Cl.[6] ..... B41M 5/30; B41M 5/40

[52] U.S. Cl. ..... 503/217; 427/152; 503/200; 503/201; 503/209; 503/214; 503/216; 503/221; 503/226

[58] Field of Search ..... 503/201, 216, 503/217, 226, 200, 209, 214; 427/150–152

[56] References Cited

U.S. PATENT DOCUMENTS

| | | | |
|---|---|---|---|
| 4,425,161 | 1/1984 | Shibahashi et al. | 106/21 R |
| 4,687,862 | 8/1987 | Obitsu et al. | 503/216 |
| 5,296,439 | 3/1994 | Maruyama et al. | 503/201 |

*Primary Examiner*—Bruce H. Hess
*Attorney, Agent, or Firm*—Cushman Darby & Cushman IP Group of Pillsbury Madison & Sutro LLP

[57] ABSTRACT

A reversible heat-sensitive recording medium which includes at least a support and formed thereon a heat-sensitive recording layer including at least the following components: an electron-donating color-forming compound having a lactone ring, (b) an electron-accepting compound having a phenolic hydroxyl group, (c) at least one organic compound selected from compounds represented by formulae (I) to (V), and (d) a thermoplastic resin having an erasing action. The content of the thermoplastic resin having an erasing action is being from 15 to 70% by weight based on the total amount of components (a) to (d) Formulae (I) to (V) are as follows:

$$R_1—CO—N(R_2)R_3 \quad (I)$$

$$R_1—CO—NH—R_4—NH—CO—R_2 \quad (II)$$

$$R_1—CO—O—R_2 \quad (III)$$

$$R_1—NH—CO—NH—R_2 \quad (IV)$$

$$R_1—CO—R_2 \quad (V)$$

wherein $R_1$ represents an alkyl group, an aryl group, an alkenyl group, or a hydroxyalkyl group; $R_2$ and $R_3$ each represents a hydrogen atom, an alkyl group, an aryl group, a hydroxyalkyl group, or an alkenyl group; and $R_4$ represents an alkylene group. This reversible heat-sensitive recording medium can be easily colored and erased by means of heat energy control.

10 Claims, 1 Drawing Sheet

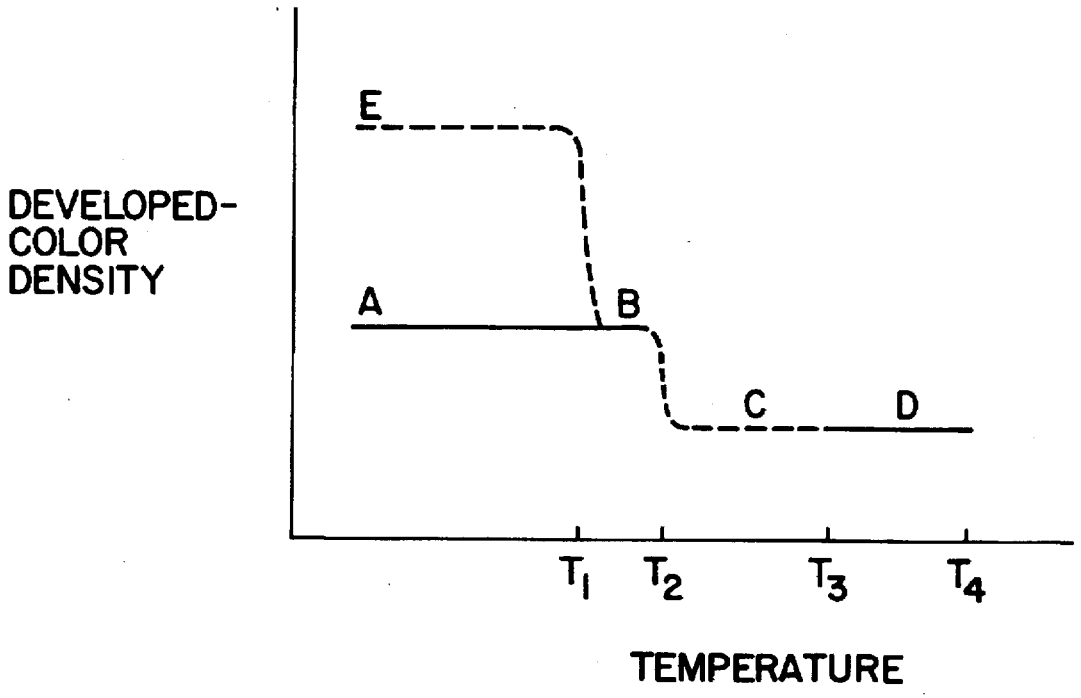
E
DEVELOPED-
COLOR
DENSITY
A
B
C
D
T1
T2
T3
T4
TEMPERATURE

REVERSIBLE HEAT-SENSITIVE RECORDING MEDIUM

FIELD OF THE INVENTION

The present invention relates to a recording medium which can be repeatedly used as a heat-sensitive recording medium, reversible recording medium, display, sensor, etc.

BACKGROUND OF THE INVENTION

The conventional reversible heat-sensitive recording materials which utilize crystalline transition, dehydration, solid-liquid change, etc. Each material has a drawback that a developed-color image cannot be fixed or that heat or light should be continuously fed in order to maintain the developed-color density. The reversible heat-sensitive recording materials disclosed in JP-A-58-191190, JP-A-60-193691, and U.S. Pat. No. 3,666,525, which comprise a color former, a color developer, and a binder and in which a color is developed with heat and the developed color is removed with water, water vapor, or a certain kind of organic solvent, are disadvantageous in that the color development and erasing cannot be repeatedly conducted by the control of heat energy. (The term "JP-A" as used herein means an "unexamined published Japanese patent application.")

As described above, the conventional reversible heat-sensitive recording media based on the reaction of a color former with a color developer have various problems.

On the other hand, the reversible heat-sensitive recording media disclosed in JP-A-2-188293 and JP-A-5-92661 contain a color former and a specific acid substance as main components. In these recording media, both color development and erasing are conducted by the control of heat energy, and a combination of a salt of gallic acid with a higher aliphatic amine and a salt of bis(hydroxyphenyl) acetic acid with a higher aliphatic amine is used as a color developer. The reversible heat-sensitive recording medium disclosed in JP-A-4-247985 also contains a color former and a reversible acid substance as main components, but employs a phosphoric ester as a color developer. Thus, a heat-sensitive recording medium with good reversibility which contains any of the acid substances having a phenolic hydroxyl group which are employed in conventional heat-sensitive recording materials such as bisphenol A, has not been obtained so far.

SUMMARY OF THE INVENTION

An object of the present invention is to provide an excellent reversible heat-sensitive recording medium which contains an electron-donating color-forming compound having a lactone ring and an electron-accepting compound having a phenolic hydroxyl group and which has a memory function and a high developed-color density, and an excellent reversibility, and in which heat energy control is the only means necessary for conducting color development and erasing can be conducted by heat energy control only.

As a result of intensive studies made by the present inventors in order to attain the above object, it has been found that the above object can be accomplished by incorporating a specific organic compound and a specific resin having good compatibility with the organic compound at high temperatures. The present invention has been achieved based on this finding.

The present invention provides a reversible heat-sensitive recording medium which comprises a support and formed thereon a heat-sensitive recording layer comprising as main components (a) an electron-donating color-forming compound having a lactone ring, (b) an electron-accepting compound having a phenolic hydroxyl group, (c) at least one organic compound selected from compounds represented by the following general formulae (I) to (V),. and (d) a thermoplastic resin having an erasing action, the content of the thermoplastic resin having an erasing action being from 15 to 70% by weight based on the total amount of components (a) to (d):

$$R_1—CO—N(R_2)R_3 \quad (I)$$

$$R_1—CO—NH—R_4—NH—CO—R_2 \quad (II)$$

$$R_1—CO—O—R_2 \quad (III)$$

$$R_1—NH—CO—NH—R_2 \quad (IV)$$

$$R_1—CO—R_2 \quad (V)$$

wherein $R_1$ represents an alkyl group, an aryl group, an alkenyl group, or a hydroxyalkyl group; $R_2$ and $R_3$ each represents a hydrogen atom, an alkyl group, an aryl group, a hydroxyalkyl group, or an alkenyl group; and $R_4$ represents an alkylene group.

The reversible heat-sensitive recording medium provided by the present invention has a heat-sensitive recording layer which comprises as main components a thermoplastic resin having an erasing action and good compatibility with the compounds represented by formulae (I) to (V), at least one organic compound selected from compounds represented by general formulae (I) to (V), an electron-donating color-forming compound having a lactone ring, and an electron-accepting compound having a phenolic hydroxyl group, and in which color development and erasing can be conducted by heat energy control.

BRIEF DESCRIPTION OF THE DRAWING

FIGURE is a graph showing reversible changes of developed-color density with respect to changes in temperature in a reversible heat-sensitive recording medium according to the present invention.

DETAILED DESCRIPTION OF THE INVENTION

The reversible heat-sensitive recording medium of the present invention becomes transparent upon heating to a color-developing temperature and assumes a color upon cooling; this colored state stably exists at ordinary temperature. On the other hand, the colored composition can be erased by heating the same to either an erasing temperature region lower than the color-developing temperature or an erasing temperature region higher than the color-developing temperature; this erased state stably exists at ordinary temperature. Thus, the reversible heat-sensitive recording medium of the present invention shows such a novel reversible behavior concerning color development and erasing, i.e., the presence of two erasing temperature regions respectively on the lower-temperature side and higher temperature side of the color-developing temperature region.

The principle of color development and erasing, i.e., image formation and image erasion, in the reversible heat-sensitive recording material of the present invention is explained by reference to FIGURE. The ordinate of the graph indicates developed-color density and the abscissa indicates temperature. The broken lines indicate a process of image formation by heating (color-developing process), and the solid lines indicate a process of image erasion by heating (erasing process). Symbol A indicates the density in a completely erased state, B indicates the density in a thermally erased state at a temperature in the range of from $T_1$ to $T_2$, C and D each indicates the density in a transparent state at an elevated temperature not lower than $T_2$, and E indicates the density in a fully colored state.

Recording (i.e., obtaining a colored state) on the heat-sensitive recording layer, which is in an erased state (A) at a temperature not higher than $T_1$, can be attained by heating the recording layer with, e.g., a thermal head to a temperature between $T_2$ and $T_3$ and then cooling the recording layer. As a result of this heat treatment, the color density changes along the broken lines, and color development occurs at a temperature not higher than $T_1$ to form a recorded image (E). This colored state (E) is maintained at any temperature not higher than $T_1$, that is, the recorded information is stably memorized.

One method for erasing the recorded image is to heat and maintain the image-formed recording layer at a temperature between $T_1$ and $T_2$ (this temperature being referred to as "lower erasing temperature"). As a result of this heat treatment, the recording layer comes into an erased state (B). Even when this recording layer is cooled again to a temperature not higher than $T_1$, it retains the erased state (A). Another method for erasion is to heat the image-formed recording layer to a temperature between $T_3$ and $T_4$ (this temperature being referred to as "higher erasing temperature") and then cool the same. As a result of this treatment, the color density changes along the solid lines, and an erased state (B) is formed at a temperature not higher than $T_2$. This recording layer retains the erased state (A) at temperatures not higher than $T_1$. T4 is the temperature at which sublimation of the phenolic substance, decomposition of the resin, etc. begin to occur, thereby causing problems such as, e.g., a change in recording characteristics and discoloration of the medium itself.

As described above, the process of image formation proceeds from A through B and C to E, and the recorded image is maintained. On the other hand, the process of recorded-image erasion proceeds from E to A through B or through B, C, and D, and the erased state is maintained. This behavior of image formation and erasion is reversible, and the processes can be repeated many times. Due to the presence of two erasing temperature regions respectively on the upper and lower sides of the color-developing temperature, the recording medium of the present invention is applicable to various image-forming systems.

The composition of the heat-sensitive recording layer contained in the recording medium of the present invention comprises an electron-donating color-forming compound having a lactone ring, an electron-accepting compound having a phenolic hydroxyl group, at least one organic compound selected from compounds represented by formulae (I) to (V), and a thermoplastic resin having an erasing action.

$R_1$ in formulae (I) to (V) each preferably has 8 or more carbon atoms, more preferably from 8 to 30 carbon atoms, most preferably from 12 to 24 carbon atoms. From the standpoint of recording characteristics, these compounds desirably have a melting point of 58° C. or higher, preferably from 58° to 160° C.

Representative examples of each of the compounds represented by formulae (I) to (V) are given below.

Examples of the organic compound represented by formula (I) include acetamide, propionamide, butyramide, valeramide, capronamide, enanthamide, capramide, pelargonamide, undecylamide, lauramide, tridecylamide, myristamide, pentadecylamide, palmitamide, heptadecylamide, stearamide, arachidamide, behenamide, cerotamide, montanamide, oleamide, erucamide, ricinoleamide, valeranilide, capronanilide, pelargonanilide, capranilide, undecylanilide, lauranilide, myristanilide, palmitanilide, stearanilide, behenanilide, N-methylcapramide, N-methyllauramide, N-methylmyristamide, N-methylpalmitamide, N-methylstearamide, N-dodecyllauramide, N-dodecylmyristamide, N-dodecylpalmitamide, N-dodecylstearamide, stearylstearamide, oleylstearamide, stearylerucamide, methylolstearamide, and methylolbehenamide.

Examples of the organic compound represented by formula (II) include methylenebisstearamide, ethylenebiscapramide, ethylenebislauramide, ethylenebisstearamide, ethyleneisobisstearamide, ethylenebishydroxystearamide, hexamethylenebisstearamide, distearylsebacamide, ethylenebisoleamide, hexamethylenebisoleamide, and m-xylenebisstearamide.

Examples of the organic compound represented by formula (III) include methyl cerotate, methyl heptacosanoate, methyl montanate, methyl melissate, ethyl cerotate, ethyl montanate, ethyl melissate, ethyl laccerate, stearyl stearate, behenyl stearate, glycol myristate, glycol stearate, glycerol laurate, glycerol myristate, glycerol palmitate, and glycerol stearate.

Examples of the urea derivative which is the organic compound represented by formula (IV) include N-butyl-N'-stearylurea, N-phenyl-N'-stearylurea, N-stearyl-N'-stearylurea, and xylenebisstearylurea.

Examples of the ketone compound represented by formula (V) include distearyl ketone.

Particularly preferred are palmitamide, stearamide, behenamide, oleamide, methylolstearamide, and ethylenebisstearamide.

The electron-donating color-forming compound having a lactone ring (component (a)) may be a conventionally known leuco dye, e.g., a triarylmethane compound or a fluoran compound. Examples thereof include crystal violet lactone, 3-dipropylamino-7-chlorofluoran, 3-cyclohexylamino-6-chlorofluoran, 3-diethylamino-6-methyl-7-chlorofluoran, 3-N,N-n-propyl-n-butylamino-7-aminofluoran, 3-butylamino-7-t-butylfluoran, 3-butylamino-7-N,N-methylphenylfluoran, 3-octylamino-7-anilinofluoran, 3-hexadecaamino-7-methylaminofluoran, 3-pyrrolidino-7-dibenzylaminofluoran, 3-dibutylamino-7-o-chloroanilinofluoran, 3-dibutylamino-7-p-3-acetylanilinofluoran, 3-pyrrolidino-7-o-toluidinofluoran, 3-N,N-cyclohexyl-n-butylamino-7-p-acetylaminofluoran, 3-octylamino-7-(2,4-dinitroanilino)fluoran, 3-N,N-n-butyl-n-propyl-7-m-acetylanilinofluoran, and 3-diethylamino-6-chloro-7-anilinofluoran.

Examples of the electron-accepting compound having a phenolic hydroxyl group (component (b)) include t-butylphenol, nonylphenol, dodecylphenol, styrenated phenols, 2,2-methylenebis(4-methyl-6-t-butylphenol), α-naphthol, β-naphthol, hydroquinone monomethyl ether, guaiacol, eugenol, p-chlorophenol, p-bromophenol, o-chlorophenol, o-bromophenol, o-phenylphenol, p-phenylphenol, p-(p-chlorophenyl)phenol, o-(o-chlorophenyl)phenol, methyl p-hydroxybenzoate, ethyl p-hydroxybenzoate, propyl p-hydroxybenzoate, butyl p-hydroxybenzoate, octyl p-hydroxybenzoate, dodecyl p-hydroxybenzoate, benzyl p-hydroxybenzoate, 3-isopropylcatechol, p-t-butylcatechol, 4,4-methylenediphenol, 4,4-thiobis(6-t-butyl-3-methylphenol), 1,1-bis(4-hydroxyphenyl)cyclohexane, 1,1-bis(4-hydroxyphenyl)cyclopentane, 1,1-bis(4-hydroxyphenyl) cycloheptane, 4,4-butylidenebis(6-t-butyl-3-methylphenol), bisphenol A, bisphenol S, 1,2-dihydroxynaphthalene, 2,3-dihydroxynaphthalene, chlorocatechol, bromocatechol, 2,4-dihydroxybenzophenone, phenolphthalein, o-cresolphthalein, methyl protocatechuate, ethyl protocatechuate, propyl protocatechuate, octyl protocatechuate, dodecyl protocatechuate, 2,4,6-trihydroxymethylbenzene, 2,3,4-trihydroxyethylbenzene, methyl gallate, ethyl gallate, propyl gallate, butyl gallate, hexyl gallate, octyl gallate, dodecyl gallate, cetyl gallate, stearyl gallate, 2,3,5-trihydroxynaphthalene, and tannic acid. Of these, 1,1-bis(4-hydroxyphenyl)cyclohexane and 1,1-bis(4-hydroxyphenyl)cyclopentane are preferred in this invention because use of either compound brings about a high developed-color density.

The thermoplastic resin having an erasing action (component (d)) is preferably a resin capable of coming into a compatibilized state with at least one organic compound selected from the compounds represented by formulae (I) to (V), at an arbitrary temperature in the range of from the melting temperature of the organic compound to 200° C. The term "compatibilized state" herein means a homogeneous state in which no phase separation is observed when the composition is observed with a microscope at 50 magnifications. Of such resins, hydrophobic resins having a glass transition temperature (hereinafter referred to as "$T_g$") of from 30° to 110° C. and having a rubber-like elasticity region at temperatures not lower than the $T_g$ are advantageously used in this invention. Especially preferred are homopolymers and copolymers of vinyl acetate, acrylic group, or methacrylic group, with the preferred weight-average molecular weight thereof being in the range of 5,000 to 2,000,000.

Specific examples of the thermoplastic resin include poly (vinyl acetate), vinyl chloride-vinyl acetate copolymers, ethylene-vinyl acetate copolymers, poly(acrylic acid), poly (methacrylic acid), poly(methyl acrylate), poly(methyl methacrylate), poly(ethyl methacrylate), poly(butyl methacrylate), acrylic acid-methacrylic acid copolymers, acrylic acid-vinyl chloride copolymers, polyacrylic acid-vinyl acetate copolymers, poly(vinyl propionate), polyurethanes, poly(vinyl butyral), polyesters, polystyrene, and styrene-acrylic copolymers.

Of the resins enumerated above, poly(vinyl acetate) and acrylic acid-methacrylic acid copolymers are advantageously used. In the present invention, the thermoplastic resin having an erasing action is not limited to the aforementioned resins, and other resins having a rubber-like elasticity region at temperatures not lower than the $T_g$ thereof may be suitably used. Resins having no rubber-like elasticity region are incapable of imparting satisfactory reversibility.

Components (a) to (d) can be prepared by any conventional methods.

The proportions of the above-described components used in the reversible heat-sensitive recording medium of the present invention can be suitably selected according to the properties of the individual components. The proportion of the electron-donating color-forming compound having a lactone ring to the electron-accepting compound having a phenolic hydroxyl group is preferably from 7:1 to 1:3, more preferably from 2:1 to 1:1, by weight. The amount of the organic compound selected from compounds represented by formulae (I) to (V) is preferably from 1 to 6 times by weight, more preferably from 3 to 4 times by weight, the sum of the electron-donating color-forming compound having a lactone ring and the electron-accepting compound having a phenolic hydroxyl group. The content of the thermoplastic resin having an erasing action is from 15 to 70% by weight, preferably from 20 to 60% by weight, more preferably from 30 to 55% by weight, based on the total amount of all the four components. If the content of the thermoplastic resin is lower than 15% by weight, satisfactory reversibility is not obtained. If the content thereof is higher than 70% by weight, a reduced developed-color density results.

The total content of components (a) to (d) in the composition of the heat-sensitive recording layer is preferably 60% by weight or more.

The reversible heat-sensitive recording medium of the present invention preferably has an interlayer and a protective layer which are formed on the heat-sensitive recording layer. The interlayer comprises a specific acrylic-silicone resin, i.e., an acrylic-silicone copolymer, an acrylic-modified silicone resin, or an ester-silicone copolymer. Due to this layer constitution, not only interlaminar peeling is prevented between the heat-sensitive recording layer and the interlayer and between the interlayer and the protective layer, but also the heat-sensitive recording layer undergoes little decrease in color-developing ability and erasability and can retain exceedingly high storage stability of images. Moreover, the recording medium is prevented from being fused to a thermal head and from depositing recording-layer debris on the thermal head, so that excellent head-matching properties are attained.

The interlayer formed on the heat-sensitive recording layer is then explained with respect to its material, i.e., an acrylic-silicone copolymer, an acrylic-modified silicone resin, or an ester-silicone copolymer.

The acrylic-silicone copolymer may be a graft copolymer comprising an acrylic resin as the backbone and silicone resin side chains made up of repeating units such as $(CH_3)_2SiO$, $R(CH_3)SiO$, $R_2SiO$, etc., or may be a random, block, or another copolymer comprising such a silicone resin and an acrylic resin. R represents an alkyl group (excluding an ethyl group) or a hydroxylalkyl group.

Examples of the acrylic monomer constituting the above acrylic resin include acrylic acid, methyl acrylate, ethyl acrylate, butyl acrylate, isobutyl acrylate, cyclohexyl acrylate, 2-ethylhexyl acrylate, hydroxyethyl acrylate, methacrylic acid, methyl methacrylate, ethyl methacrylate, butyl methacrylate, isobutyl methacrylate, cyclohexyl methacrylate, 2-ethylhexyl methacrylate, and t-butyl methacrylate.

The acrylic-modified silicone resin may be, for example, a so-called acrylic-modified silicone resin or methacrylic-modified silicone resin, which each comprises a silicone resin having acrylic or methacrylic groups as terminal groups.

The ester-silicone copolymer may be a graft copolymer comprising a polyester as the backbone and silicone resin side chains made up of repeating units such as $(CH_3)_2SiO$, $R(CH_3)SiO$, $R_2SiO$, etc., or may be a random, block, or another copolymer comprising such a silicone resin and a polyester. R is the same as described above.

The interlayer comprising the specific acrylic-silicone resin described above is formed by preparing a coating fluid by homogeneously mixing and dispersing the resin optionally along with a thermosetting resin and applying the coating fluid to form a film. The proportion of the acrylic-silicone resin in this invention is such that the content of siloxane bond (Si—O—Si) parts of the acrylic-silicone resin is preferably from 0.5 to 60% by weight, more preferably from 1 to 30% by weight based on the weight of the interlayer.

Examples of the thermosetting resin include acrylic resins, urethane resins, polyester resins, urea resins, epoxy resins, and melamine resins.

The protective layer to be formed on the interlayer is explained below.

An ultraviolet-curing or electron beam-curing resin may be used for forming the protective layer in this invention. This resin is preferably a homopolymer or copolymer of an acrylic monomer.

Examples of the acrylic monomer constituting the above acrylic resin include acrylic acid, methyl acrylate, ethyl acrylate, butyl acrylate, isobutyl acrylate, cyclohexyl acrylate, 2-ethylhexyl acrylate, hydroxyethyl acrylate, methacrylic acid, methyl methacrylate, ethyl methacrylate, butyl methacrylate, isobutyl methacrylate, cyclohexyl methacrylate, 2-ethylhexyl methacrylate, and t-butyl methacrylate. Besides such acrylic resins, a phosphazene resin is also usable.

The reversible heat-sensitive recording medium of the present invention can be obtained, for example, by the following method.

A coating fluid for heat-sensitive recording layer formation can be prepared by adding an electron-donating color-forming compound having a lactone ring, an electron-accepting compound having a phenolic hydroxyl group, at least one organic compound represented by any of formulae (I) to (V), and a thermoplastic resin having an erasing ability and optionally other components such as a filler which enhances the distinctness of developed color (e.g., calcium carbonate, calcium oxide or silica) and a plasticizer, adding a solvent (e.g., toluene or THF) thereto, and mixing the resulting contents in a dispersing apparatus. This coating fluid for heat-sensitive recording layer formation is then evenly applied to a support, e.g., a plastic sheet or paper, at a thickness of from 2 to 20 μm on a dry basis.

Subsequently, an interlayer is formed on the heat-sensitive recording layer as follows. The specific acrylic-silicone resin, and optionally a thermosetting resin, an ultraviolet absorber, a lubricant, etc., are added and then a solvent (e.g., toluene, xylene or hexane) is added and mixed in a dispersing apparatus. The mixture is mixed in a dispersing apparatus. The thus-prepared coating fluid for interlayer formation is applied to the heat-sensitive recording layer and dried. The dry coating is heated at a prescribed curing temperature to cure, thereby forming an interlayer having a thickness of from 0.2 to 4 μm.

A protective layer is then formed on the interlayer by preparing a coating fluid for protective layer formation from the ultraviolet-curing or electron beam-curing resin described above and optional components such as a filler and a lubricant, applying the coating fluid at a thickness of from 1 to 5 μm on a dry basis, and irradiating the coating with ultraviolet or electron beams to cure the coating. Examples of the filler used for the above include titanium oxide, zinc oxide, calcium carbonate, aluminum oxide, silicon dioxide, clay, and talc. Examples of the lubricant include metal salts of stearic acid, various waxes, and salts of higher fatty acids.

Thus, the reversible heat-sensitive recording medium of the present invention is obtained.

The present invention will be explained below in more detail by reference to the following Examples and Comparative Examples, wherein all "parts" are by weight.

EXAMPLE 1

A coating fluid for heat-sensitive recording layer formation which had the following composition was prepared by mixing the following components in a dispersing apparatus employing glass beads. This coating fluid was applied to a 75 μm-thick polyethylene terephthalate (PET) film with a bar coater, and dried at 155° C. for 5 minutes to form a heat-sensitive recording layer having a thickness of 10 μm. Thus, a reversible heat-sensitive recording medium according to the present invention was produced.

| | |
|---|---|
| 3-Dibutylamino-7-o-chloroanilinofluoran | 2 parts |
| Bisphenol A | 2 parts |
| Stearamide | 10 parts |
| Poly(vinyl acetate) (Sakunol SN-10, manufactured by Denki Kagaku Kogyo K. K., Japan; $T_g$, 38° C.) | 8 parts |
| Tetrahydrofuran | 80 parts |

EXAMPLE 2

Using a coating fluid having the following composition, a reversible heat-sensitive recording medium according to the present invention was produced in the same manner as in Example 1.

| | |
|---|---|
| 3-Dibutylamino-7-o-chloroanilinofluoran | 2 parts |
| Bisphenol A | 2 parts |
| Stearamide | 10 parts |
| Poly(vinyl acetate) (Sakunol SN-10, manufactured by Denki Kagaku Kogyo K. K.) | 20 parts |
| Tetrahydrofuran | 112 parts |

EXAMPLE 3

Using a coating fluid having the following composition, a reversible heat-sensitive recording medium according to the present invention was produced in the same manner as in Example 1.

| | |
|---|---|
| 3-Dibutylamino-7-o-chloroanilinofluoran | 5 parts |
| Bisphenol A | 1 part |
| Stearamide | 6 parts |
| Poly(vinyl acetate) (Sakunol SN-10, manufactured by Denki Kagaku Kogyo K. K.) | 4 parts |
| Tetrahydrofuran | 64 parts |

EXAMPLE 4

Using a coating fluid having the following composition, a reversible heat-sensitive recording medium according to the present invention was produced in the same manner as in Example 1.

| | |
|---|---|
| 3-Dibutylamino-7-o-chloroanilinofluoran | 1 part |
| Bisphenol A | 1 part |
| Stearamide | 12 parts |
| Poly(vinyl acetate) (Sakunol SN-10, manufactured by | 7 parts |

-continued

| | |
|---|---|
| Denki Kagaku Kogyo K. K.) | |
| Tetrahydrofuran | 92 parts |

EXAMPLE 5

A reversible heat-sensitive recording medium according to the present invention was produced in the same manner as in Example 1, except that palmitamide was used in place of stearamide.

EXAMPLE 6

Using a coating fluid having the following composition, a reversible heat-sensitive recording medium according to the present invention was produced in the same manner as in Example 1.

| | |
|---|---|
| Crystal violet lactone | 2 parts |
| Bisphenol A | 1 part |
| Ethylenebisstearamide | 9 parts |
| Poly(vinyl acetate) | 2 parts |
| Acrylic resin (Dianal BR-113, manufactured by Mitsubishi Rayon Co., Ltd., Japan; $T_g$, 70° C.) | 6 parts |
| Tetrahydrofuran | 84 parts |

EXAMPLE 7

A reversible heat-sensitive recording medium according to the present invention was produced in the same manner as in Example 1, except that methylolstearamide was used in place of stearamide.

EXAMPLE 8

A reversible heat-sensitive recording medium according to the present invention was produced in the same manner as in Example 1, except that 1,1-bis(4-hydroxyphenyl) cyclohexane was used in place of bisphenol A.

EXAMPLE 9

A reversible heat-sensitive recording medium according to the present invention was produced in the same manner as in Example 1, except that 1,1-bis(4-hydroxyphenyl) cyclopentane was used in place of bisphenol A.

EXAMPLE 10

Formation of Heat-sensitive Recording Layer

| | |
|---|---|
| 3-Dibutylamino-7-o-chloroanilinofluoran | 2.0 parts |
| Bisphenol A | 2.0 parts |
| Stearamide | 10.0 parts |
| Poly(vinyl acetate) (Sakunol SN-10, manufactured by Denki Kagaku Kogyo K. K.) | 6.0 parts |
| Tetrahydrofuran | 80.0 parts |

A coating fluid for heat-sensitive recording layer formation which had the composition shown above was obtained by mixing the above components for 1 hour in a dispersing apparatus employing glass beads. This coating fluid was applied to a 75 μm-thick PET film with a bar coater, and dried at 155° C. for 5 minutes to form a heat-sensitive recording layer having a thickness of 10 μm.

Formation of Interlayer

| | |
|---|---|
| Thermosetting polyester resin (Bright 30-8N, manufactured by Nippon Kako Toryo K. K., Japan) | 85.0 parts |
| Xylene | 10.0 parts |
| Acrylic-silicone copolymer (X-22-8004, manufactured by Shin-Etsu Chemical Co., Ltd., Japan) | 5.0 parts |

A coating fluid for interlayer formation which had the composition shown above was obtained through 30-minute dispersion treatment. This coating fluid was applied to the heat-sensitive recording layer, dried, and then heated at 40° C. for 48 hours to form an interlayer having a thickness of 1.5 μm.

Formation of Protective Layer

| | |
|---|---|
| Ultraviolet-curing acrylic resin (KRM7033, manufactured by Daicel U.C.B. Co., Ltd.) | 95.0 parts |
| MEK (Methyl Ethyl Ketone) | 5.0 parts |

A coating fluid for protective layer formation which had the composition shown above was obtained through 30-minute dispersion treatment. This coating fluid was applied to the interlayer, dried, and then irradiated with 600-mJ/cm$^2$ ultraviolet to form a protective layer having a thickness of 3 μm. Thus, a reversible heat-sensitive recording medium according to the present invention was produced.

EXAMPLE 11

A reversible heat-sensitive recording medium according to the present invention was produced in the same manner as in Example 10, except that in forming the interlayer, the amounts of the acrylic-silicone copolymer and the thermosetting polyester resin were changed to 20.0 parts and 70.0 parts, respectively.

EXAMPLE 12

A reversible heat-sensitive recording medium according to the present invention was produced in the same manner as in Example 10, except that in forming the interlayer, the amounts of the acrylic-silicone copolymer and the thermosetting polyester resin were changed to 40.0 parts and 50.0 parts, respectively.

EXAMPLE 13

A reversible heat-sensitive recording medium according to the present invention was produced in the same manner as in Example 10, except that in forming the interlayer, 3.0 parts of an acrylic-modified silicone resin (X-24-4011, manufactured by Shin-Etsu Chemical Co., Ltd.) was used in place of the acrylic-silicone copolymer and the amount of the thermosetting polyester resin was changed to 87.0 parts.

EXAMPLE 14

A reversible heat-sensitive recording medium according to the present invention was produced in the same manner as in Example 10, except that in forming the interlayer, 90.0 parts of a thermosetting silicone-containing polyester (Bright 30-8, manufactured by Nippon Kako Toryo K.K.) was used as an ester-silicone copolymer resin in place of the acrylic-silicone copolymer.

COMPARATIVE EXAMPLE 1

The same procedure as in Example 1 was carried out, except that the amounts of stearamide and poly(vinyl acetate) were changed to 2 parts and 20 parts, respectively. Thus, a comparative reversible heat-sensitive recording medium was produced.

COMPARATIVE EXAMPLE 2

The same procedure as in Example 1 was carried out, except that stearamide was omitted. Thus, a comparative reversible heat-sensitive recording medium was produced.

COMPARATIVE EXAMPLE 3

The same procedure as in Example 1 was carried out, except that the amount of poly(vinyl acetate) was changed to 1.5 parts. Thus, a comparative reversible heat-sensitive recording medium was produced.

COMPARATIVE EXAMPLE 4

The same procedure as in Example 1 was carried out, except that a polycarbonate (Toughion A-3000, manufactured by Idemitsu Petrochemical Co., Ltd., Japan) was used in place of poly(vinyl acetate). Thus, a comparative reversible heat-sensitive recording medium was produced.

COMPARATIVE EXAMPLE 5

The same procedure as in Example 1 was carried out, except that 88 parts of 7% by weight aqueous poly(vinyl alcohol) solution was used in place of poly(vinyl acetate) and tetrahydrofuran. Thus, a comparative reversible heat-sensitive recording medium was produced.

The reversible heat-sensitive recording media obtained in Examples 1 to 14 and Comparative Examples 1 to 5 were evaluated by two erasing methods. In one method, erasing was conducted at a temperature higher than a color-developing temperature (Evaluation A) o In the other method, erasing was conducted at a temperature lower than the color-developing temperature (Evaluation B).

Evaluation A

Each reversible heat-sensitive recording medium was heated by placing it on a 130° C. hot plate and then cooled to ordinary temperature to evaluate the medium for colored state (developed-color density) and for the cooling time necessary for color development (rate of reaction). Subsequently, the medium was heated by placing it on a 160° C. hot plate and then cooled to bring the medium into an erased state as a result of heating to that erasing temperature, which was higher than the color-developing temperature. This erased state (erased-color density) and the cooling time necessary for erasing (rate of reaction) were evaluated. This medium was subjected to the same thermal cycling, that is, the medium was heated to 130° C., cooled, subsequently heated to 160° C., and then cooled, to examine reproducibility. Thus, reversibility was evaluated. In the above evaluations, color densities were measured with a reflection densitometer (RD-914, manufactured by Macbeth Co.). Rate of reaction and reversibility were visually examined; media satisfactory to practical use are indicated by "A", media causing no trouble in practical use but slightly inferior are indicated by "B, and media causing a trouble in practical use are indicated by "C". The results of these evaluations are shown in Table 1.

TABLE 1

| | Developed-color Density | Erased-color Density | Reversibility | Rate of Reaction for Color Development | Rate of Reaction for Erasing |
|---|---|---|---|---|---|
| Example 1 | 1.18 | 0.08 | A | A | A |
| Example 2 | 1.03 | 0.09 | B | B | A |
| Example 3 | 1.06 | 0.09 | B | A | B |
| Example 4 | 1.18 | 0.11 | B | A | B |
| Example 5 | 1.11 | 0.09 | A | A | A |
| Example 6 | 1.05 | 0.10 | B | A | B |
| Example 7 | 1.21 | 0.09 | A | A | A |
| Example 8 | 1.25 | 0.10 | A | A | A |
| Example 9 | 1.28 | 0.08 | A | A | A |
| Example 10 | 1.16 | 0.11 | A | A | A |
| Example 11 | 1.15 | 0.10 | A | A | A |
| Example 12 | 1.22 | 0.09 | A | A | A |
| Example 13 | 1.18 | 0.09 | A | A | A |
| Example 14 | 1.23 | 0.10 | A | A | A |
| Comaprative Example 1 | 0.24 | 0.11 | C | — | — |
| Comparative Example 2 | 0.20 | 0.10 | C | — | — |
| Comparative Example 3 | 1.12 | 1.10 | C | — | — |
| Comparative Example 4 | 1.16 | 1.11 | C | — | — |
| Comparative Example 5 | 1.11 | 1.11 | C | — | — |

Evaluation B

Each reversible heat-sensitive recording medium was heated with a 130° C. hot stamping die (2 kgf/cm$^2$, 0.5 sec) and then cooled to ordinary temperature to measure the color density in a colored state (developed-color density) with a reflection densitometer (RD-914, manufactured by Macbeth Co.). Subsequently, the medium was contacted for 30 seconds with a 100° C. hot plate and then cooled to ordinary temperature to bring the medium into an erased state (as a result of heating to that erasing temperature, which was lower than the color-developing temperature). The color density in this erased state (erased-color density) was measured with the reflection densitometer. The above-described color development and erasing were repeated to visually examine reversibility and to evaluate the number of repetitions necessary for the medium to undergo a considerable decrease in reversibility (specifically, a decrease in contrast, i.e., difference between the developed-color density and the erased-color density, to 60% or less of the initial value) or to undergo a trouble, e.g., peeling or cracking. Media having satisfactory reversibility are indicated by "A", media causing no trouble concerning reversibility in practical use but undergoing a decrease in reversibility as a result of repetitions of color development and erasing are indicated by "B", and media having poor reversibility insufficient for practical use are indicated by "C".

The results of the above evaluations are shown in Table 2.

TABLE 2

| | Developed-color Density | Erased-color Density | Reversibility | Number of Repetitions |
|---|---|---|---|---|
| Example 1 | 1.16 | 0.09 | B | 16 |
| Example 2 | 1.04 | 0.08 | B | 18 |
| Example 3 | 1.11 | 0.11 | B | 11 |
| Example 4 | 1.12 | 0.10 | B | 12 |
| Example 5 | 1.08 | 0.09 | B | 14 |
| Example 6 | 1.14 | 0.09 | B | 10 |
| Example 7 | 1.07 | 0.08 | B | 12 |
| Example 8 | 1.24 | 0.09 | B | 15 |
| Example 9 | 1.31 | 0.09 | B | 16 |
| Example 10 | 1.14 | 0.09 | A | 92 |
| Example 11 | 1.12 | 0.08 | A | 65 |

TABLE 2-continued

| | Developed-color Density | Erased-color Density | Reversibility | Number of Repetitions |
|---|---|---|---|---|
| Example 12 | 1.21 | 0.09 | A | 31 |
| Example 13 | 1.16 | 0.10 | A | 62 |
| Example 14 | 1.25 | 0.07 | A | 88 |
| Comparative Example 1 | 0.23 | 0.11 | C | 0 |
| Comparative Example 2 | 0.18 | 0.10 | C | 0 |
| Comparative Example 3 | 1.10 | 1.08 | C | 0 |
| Comparative Example 4 | 1.15 | 1.22 | C | 0 |
| Comparative Example 5 | 1.18 | 1.21 | C | 0 |

As apparent from the results summarized in Tables 1 and 2, the reversible heat-sensitive recording media of the present invention had a high developed-color density and showed satisfactory color-developing ability and erasability in repetitions of color development and erasing which used two erasing temperatures respectively lower and higher than the color-developing temperature. Thus, the media of this invention were ascertained to have excellent reversibility. In contrast, the heat-sensitive recording medium obtained in Comparative 1 (having a thermoplastic resin content of 77% by weight) and the heat-sensitive recording medium obtained in Comparative Example 2 (containing no compound represented by any of formulae I to V) remained uncolored even when the heating temperature and cooling conditions were varied. The heat-sensitive recording medium obtained in Comparative Example 3 (having a thermoplastic resin content of 10% by weight) remained black, showing no reversibility. Further, the heat-sensitive recording medium obtained in Comparative Example 4 (employing a thermoplastic resin having no erasing action because of its high $T_g$ and its poor compatibility with the organic compound represented by any of the formulae) and the heat-sensitive recording medium obtained in Comparative Example 5 (employing a water-soluble thermoplastic resin having no erasing action because of its poor compatibility in the heat-sensitive layer) failed to undergo erasion of a developed color image, showing no reversibility.

The reversible heat-sensitive recording medium of the present invention can be easily colored and erased by means of heat energy control, and has a high contrast and a memory function. Hence, the recording medium is usable as a rewritable heat-sensitive recording medium. Furthermore, since the recording medium of this invention has two erasing temperature regions respectively on the lower side and the higher side of a color-developing temperature, various applications thereof are expected.

While the invention has been described in detail and with reference to specific embodiments thereof, it will be apparent to one skilled in the art that various changes and modifications can be made therein without departing from the spirit and scope thereof.

What is claimed is:

1. A reversible heat-sensitive recording medium which comprises:

a support;

a heat-sensitive recording layer formed on the support and comprising components (a) an electron-donating color-forming compound having a lactone ring, (b) an electron-accepting compound having a phenolic hydroxyl group, (c) at least one organic compound selected from compounds represented by formulae (I) to (V), and (d) a thermoplastic resin having an erasing action, the content of the thermoplastic resin having an erasing action being from 15 to 70% by weight based on the total amount of the components (a) to (d);

a protective layer formulated from an ultraviolet-curing or electron beam-curing resin; and an interlayer disposed between the protective layer and the heat-sensitive recording layer, the interlayer comprising at least one resin selected from the group consisting of an acrylic-silicone copolymer, an ester-silicone copolymer, and an acrylic-modified silicone resin, wherein the formulae (I) to (V) are as follows:

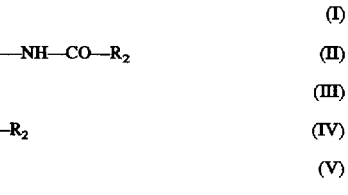

$$R_1\text{-}CO\text{—}N(R_2)R_3 \quad (I)$$

$$R_1\text{—}CO\text{—}NH\text{—}R_4\text{—}NH\text{—}CO\text{—}R_2 \quad (II)$$

$$R_1\text{—}CO\text{—}O\text{—}R_2 \quad (III)$$

$$R_1\text{—}NH\text{—}CO\text{—}NH\text{—}R_2 \quad (IV)$$

$$R_1\text{—}CO\text{—}R_2 \quad (V)$$

wherein $R_1$ represents an alkyl group, an aryl group, an alkenyl group, or a hydroxyalkyl group; $R_2$ and $R_3$ each represents a hydrogen atom, an alkyl group, an aryl group, a hydroxyalkyl group, or an alkenyl group; and $R_4$ represents an alkylene group.

2. The reversible heat-sensitive recording medium of claim 1, wherein the thermoplastic resin having an erasing action is capable of coming into a compatibilized state with the at least one organic compound selected from compounds represented by formulae (I) to (V), at a temperature in the range of from the melting point of the organic compound to 200° C.

3. The reversible heat-sensitive recording medium of claim 1, wherein the thermoplastic resin having an erasing action is a hydrophobic resin having a glass transition temperature of from 30° to 110° C. and having a rubber-like elasticity region at temperatures not lower than the glass transition temperature.

4. The reversible heat-sensitive recording medium of claim 1, wherein the at least one organic compound is selected from the compounds of formulae (I) to (V) where $R_1$ contains from 8 to 30 carbon atoms, has a melting point higher than 58° C., and is added in an amount of 20% by weight or higher based on the total amount of components (a) to (d).

5. A reversible heat-sensitive recording medium which comprises:

a support;

a heat-sensitive recording layer formed on the support and comprising components (a) an electron-donating color-forming compound having a lactone ring, (b) an electron-accepting compound having a phenolic hydroxyl group, (c) at least one organic compound selected from compounds represented by formulae (I) to (V), and (d) a thermoplastic resin having an erasing action, the content of the thermoplastic resin having an erasing action being from 15 to 70% by weight based on the total amount of the components (a) to (d);

a protective layer formulated from an ultraviolet-curing or electron beam-curing resin; and an interlayer disposed between the protective layer and the heat-sensitive recording layer, the interlayer comprising at least one resin selected from the group consisting of an acrylic-silicone copolymer, an ester-silicone copolymer, and an acrylic-modified silicone resin, wherein the formulae (I) to (V) are as follows:

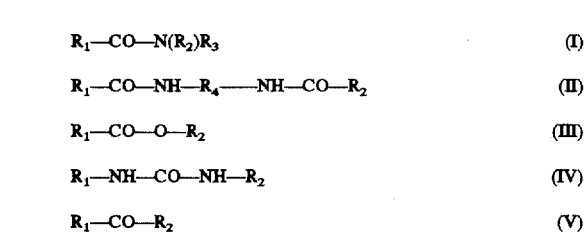

$$R_1—CO—N(R_2)R_3 \quad (I)$$

$$R_1—CO—NH—R_4—NH—CO—R_2 \quad (II)$$

$$R_1—CO—O—R_2 \quad (III)$$

$$R_1—NH—CO—NH—R_2 \quad (IV)$$

$$R_1—CO—R_2 \quad (V)$$

wherein $R_1$ represents an alkyl group, an aryl group, an alkenyl group, or a hydroxyalkyl group; $R_2$ and $R_3$ each represents a hydrogen atom, an alkyl group, an aryl group, a hydroxyalkyl group, or an alkenyl group; and $R_4$ represents an alkylene group, and further wherein the heat-sensitive recording layer has a color-developing temperature at which a color is developed upon heating and has two erasing temperatures at which the color is removed upon heating, one of the erasing temperatures being lower than the color-developing temperature and the other being higher than the color-developing temperature.

6. A reversible heat-sensitive recording medium which comprises:

a support;

a heat-sensitive recording layer formed on the support and comprising components (a) an electron-donating color-forming compound having a lactone ring, (b) an electron-accepting compound having a phenolic hydroxyl group, (c) at least one organic compound selected from compounds represented by formulae (I) to (V), and (d) a thermoplastic resin having an erasing action, the content of the thermoplastic resin having an erasing action being from 15 to 70% by weight based on the total amount of the components (a) to (d), wherein the formulae (I) to (V) are as follows:

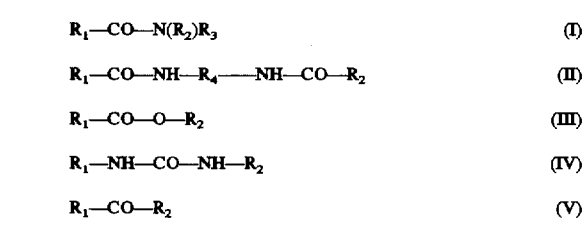

$$R_1—CO—N(R_2)R_3 \quad (I)$$

$$R_1—CO—NH—R_4—NH—CO—R_2 \quad (II)$$

$$R_1—CO—O—R_2 \quad (III)$$

$$R_1—NH—CO—NH—R_2 \quad (IV)$$

$$R_1—CO—R_2 \quad (V)$$

wherein $R_1$ represents an alkyl group, an aryl group, an alkenyl group, or a hydroxyalkyl group; $R_2$ and $R_3$ each represents a hydrogen atom, an alkyl group, an aryl group, a hydroxyalkyl group, or an alkenyl group; and $R_4$ represents an alkylene group, and wherein the heat-sensitive recording layer is capable of exhibiting an erased state at room temperature and a colored state at room temperature and is reversibly convertible between the erased state and the colored state by thermal treatment, the heat-sensitive recording layer being adapted to undergo a first transition from the colored state to the erased state by heating the heat-sensitive recording layer from room temperature to a first temperature range that is higher than room temperature and thereafter cooling the heat-sensitive recording layer to below the first temperature range, the heat-sensitive recording layer being adapted to undergo a second transition from the erased state to the colored state by heating the heat-sensitive recording layer from room temperature to a second temperature range that is higher than the first temperature range and thereafter cooling the heat-sensitive recording layer to below the first temperature range, and the heat sensitive recording layer being adapted to undergo a third transition from the colored state to the erased state by heating the heat-sensitive recording layer from room temperature to a third temperature range that is higher than the second temperature range and thereafter cooling the heat-sensitive recording layer to below the first temperature range.

7. The reversible heat-sensitive recording medium of claim 6, wherein the thermoplastic resin having an erasing action is capable of coming into a compatibilized state with the at least one organic compound selected from the compounds represented by formulae (I) to (V), at a temperature in the range of from the melting point of the organic compound to 200° C.

8. The reversible heat-sensitive recording medium of claim 6, wherein the thermoplastic resin having an erasing action is a hydrophobic resin having a glass transition temperature of from 30° to 110° C. and having a rubber-like plasticity region at temperatures not lower than the glass transition temperature.

9. The reversible heat-sensitive recording medium of claim 6, wherein the at least one organic compound is selected from the compounds of formulae (I) to (V) where $R_1$ contains from 8 to 30 carbon atoms, has a melting point higher than 58° C., and is added in an amount of 20% by weight or higher based on the total amount of components (a) to (d).

10. The reversible heat-sensitive recording medium of claim 6, further comprising:

a protective layer formulated from an ultraviolet-curing or electron beam-curing resin; and an interlayer disposed between the protective layer and the heat-sensitive recording layer, the interlayer comprising at least one resin selected from the group consisting of an acrylic-silicone copolymer, an ester-silicone copolymer, and an acrylic-modified silicone resin.

* * * * *